United States Patent [19]

Wattles et al.

[11] 4,083,504

[45] Apr. 11, 1978

[54] ROTARY PROCESSING APPARATUS

[75] Inventors: Gurdon B. Wattles, North Haven; Robert N. Jones, Wallingford, both of Conn.

[73] Assignee: Entoleter, Inc., Hamden, Conn.

[21] Appl. No.: 770,365

[22] Filed: Feb. 22, 1977

Related U.S. Application Data

[63] Continuation of Ser. No. 576,322, May 12, 1975, abandoned.

[51] Int. Cl.[2] ..... B02C 13/09

[52] U.S. Cl. ..... 241/275; 241/285 B; 277/17; 277/59

[58] Field of Search ..... 241/275, 285, 188, 189, 241/186.1, 202, 209–213, 100; 277/17, 20, 21, 50, 59

[56] References Cited

U.S. PATENT DOCUMENTS

| | | | |
|---|---|---|---|
| 526,043 | 9/1894 | Merrill | 241/285 B |
| 2,276,940 | 3/1942 | Dellinger et al. | 241/100 |
| 2,339,737 | 1/1944 | Hulse | 241/188 A |
| 2,570,527 | 10/1951 | Dahl | 74/242.15 R |
| 2,981,490 | 4/1961 | Conley | 241/285 R |
| 3,102,781 | 9/1963 | Hoskins et al. | 241/188 A |
| 3,128,052 | 4/1964 | Wagner | 241/285 B |
| 3,224,689 | 12/1965 | Behrens | 241/244 |
| 3,444,830 | 5/1969 | Doetsch | 267/65 R |
| 3,785,659 | 1/1974 | Maurer et al. | 277/59 |

*Primary Examiner*—Neil Abrams

*Attorney, Agent, or Firm*—Nelson E. Kimmelman

[57] ABSTRACT

This apparatus comprises a supporting frame for two upstanding chutes though which flowable, particulate materials may be applied. These materials flow down the chutes though an opening in the top skirt plate supported by the frame and into a processing area such as the rotor of a centrifugal impact milling machine. A motor is mounted for horizontal pivotal movement relative to the chutes and drives a vertical spindle located between the chutes that is connected to the rotary processing member below the skirt such as the rotor of a centrifugal impact machine. A hopper is provided to swing pivotally downward below the rotor in a damped fashion, the pivoting mechanism being fixed to the top skirt and enabling one man removability of the hopper to allow access to the rotor or the inside of the hopper for cleaning, maintenance, etc. A single man, by pulling up on the hopper and abetted by the upward-biasing effect of a gas spring component of the pivoting mechanism, can remount the hopper in its normal fixed position. Provision is made for easy withdrawal of the shaft or spindle assembly from the top after the rotor has been detached therefrom. The shaft or spindle assembly also includes at its lower end an easily removable seal cartridge that can be extracted from below by appropriate extraction tools engaging passageways in the cartridge after a transverse retaining pin, accessible from the outside of the spindle housing, is pulled out from engagement with a corresponding retaining channel in the seal cartridge itself.

13 Claims, 5 Drawing Figures

FIG. 1
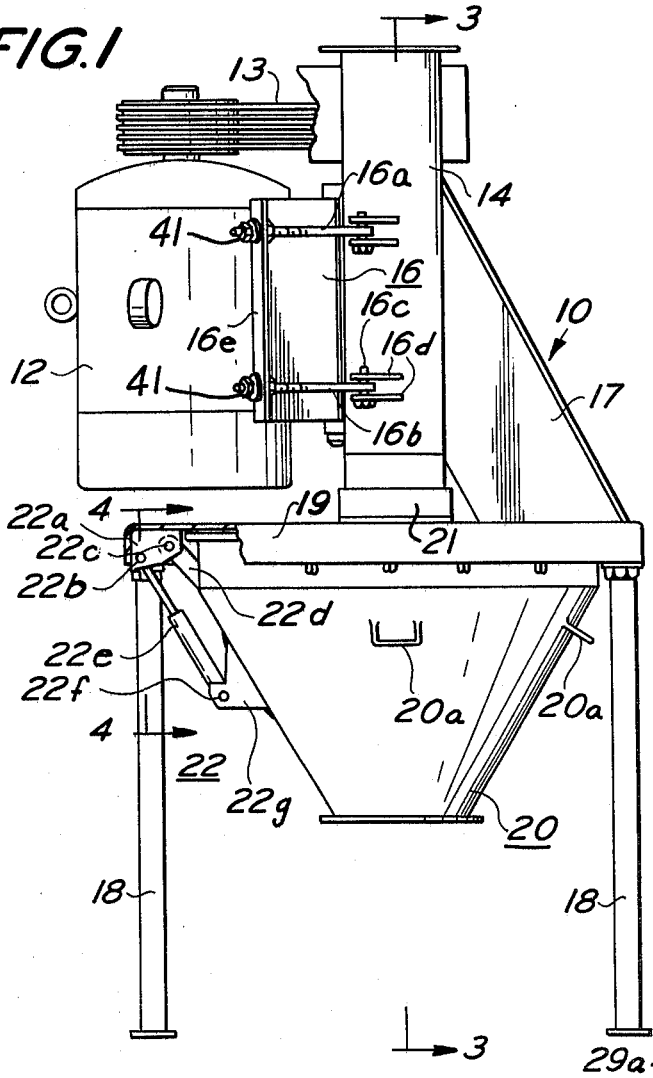
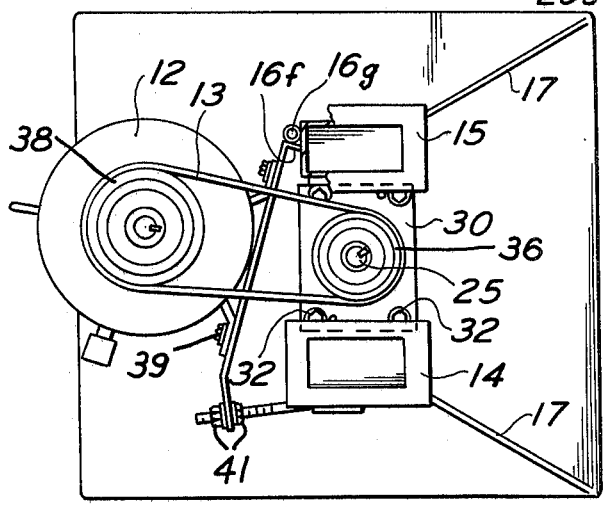
FIG. 2
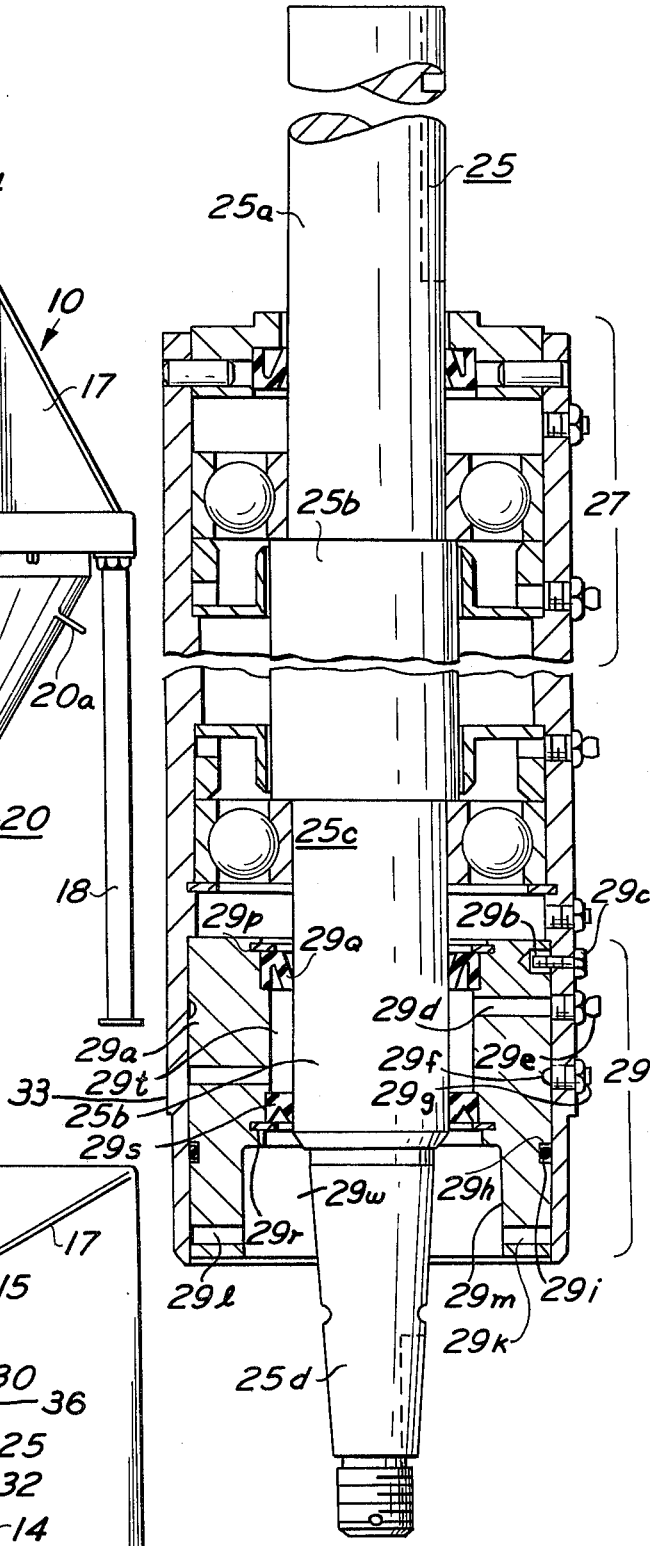
FIG. 5

ROTARY PROCESSING APPARATUS

This is a continuation of application Ser. No. 576,322, filed May 12, 1975 now abandoned.

BACKGROUND OF THE INVENTION

1. Field of the Invention

This invention relates to rotary processing apparatus and in particular to an improved centrifugal impacting machine.

2. Prior Art

Previous models of rotary processing apparatus such as centrifugal impacting machines were relatively bulky and consumed a great deal of floor space. They often required, because of their construction, special motors which were mounted or dismounted with considerable difficulty relative to the vertical spindles which the motor drove. If the rotary processing machines were equipped with hoppers into which the material processed by the rotor was gathered, it was often difficult and sometimes dangerous to remove the hopper to gain access to the rotor or the inside of the hopper for cleaning, maintenance, etc. If the machine was very large and the hopper was too, there was a danger of injury to the operator when the hopper was removed from the machine.

Prior art rotary processing apparatus was so built that it was difficult to gain access to the spindle or shaft seals for maintenance, cleaning or replacement.

There has therefore been a demand for a more compact machine which uses less floor space, for a machine in which access to the rotor and the inside of the hopper could be gained by a single operator without appreciable risk of harm and for a machine wherein a spindle or shaft seal could be easily and quickly removed from the spindle housing without removal of the spindle itself. There has also been a demand for a machine in which the spindle itself could easily be removed vertically upward by removal of a few bolts within a very short time. It is among the objects of the present invention to meet the needs and demands as set forth above.

BRIEF SUMMARY OF THE INVENTION

A rotary processing apparatus having a spindle which passes through a supporting frame assembly and is provided with a rotor for processing material. In accordance with one feature of the invention, there is a hopper means or equivalent into which the processed material falls which is pivotally mounted to said frame permitting it to be swung downward from a position below and around said rotor to a position enabling access to the interior of the hopper and to the vicinity of said rotor. In accordance with another feature of the invention, the spindle is provided with a removable seal cartridge. Another feature of the invention is a simple means for maintaining the spindle in the proper orientation which also can easily be removed to permit withdrawal of the spindle upward (after the rotor has been removed) by simple release of a few conventional retaining devices.

BRIEF DESCRIPTION OF THE DRAWINGS

FIG. 1 is a side-elevation view of the novel apparatus in accordance with the invention;

FIG. 2 is a plan view of the apparatus depicted in FIG. 1;

FIG. 5 is a cross-sectional view of the spindle assembly including the novel removable seal cartridge taken along the section line 5—5 in the direction indicated.

DETAILED DESCRIPTION OF THE DRAWINGS

Figures 3, 4:
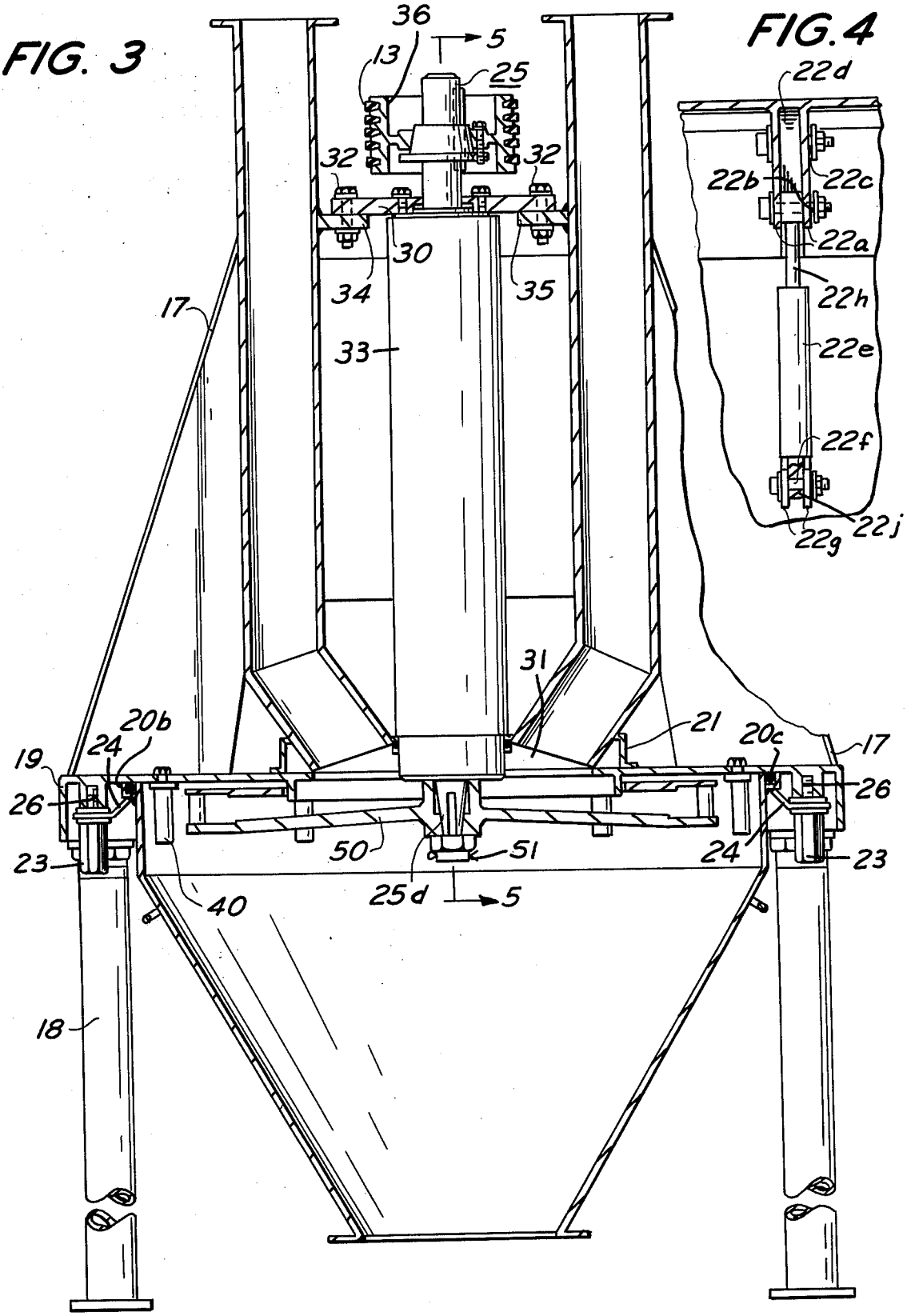
FIG. 3 is a sectional view of the apparatus shown in FIG. 1 taken along the section line 3—3 in the direction indicated.
FIG. 4 is an enlarged, partly cross-sectional view of the pivoting mechanism as shown in FIG. 1 taken along section line 4—4 in the direction indicated.

Referring to FIGS. 1, 2 and 3, there is shown generally at the numeral 10 the improved mill or other rotary apparatus constructed in accordance with the present invention. The mill is supported by four legs 18 on which the top body skirt 19 is mounted. From skirt 19 is suspended a hopper 20 by means of a plurality of angled apertured members 24 retained in place by hexagonal nuts 23 that are screwed into threaded apertures 26 formed in the top skirt. The inner edges of the members 24 bear against the lower surface of a U-shaped channel, upper edge section **20*b* of the hopper 20 into which a sealing O-ring 20*c* is inserted. The hex nuts 23 depend below the lower edge of the skirt 19** so that they may be engaged by wrenches or other appropriate tools, wielded by a person standing outside of the skirt.

On top of the skirt 19 are mounted two input chutes 14 and 15 with upper flanges adapted to be connected to a source of flowable particulate material, for example. The bottoms of these chutes 14, 15 are attached to a cover box 21 having two substantially rectangular holes which are contiguous to the lower ends of the chutes and a central hole through which the central shaft housing 33 passes, the box 31 being detachably fixed on top of the central opening in the skirt 19. The chutes 14, 15 are assisted in remaining rigid and upright by means of angled braces 17 that are integral with or otherwise attached to the top of the skirt 19.

Between the chutes 14, 15, is located a perpendicular rotating shaft assembly 25 connected to a sheave 36 that is driven by the belt 13 which is also attached to another sheave 38. At the lower end **25*d* of shaft 25 a rotor 50 is secured by a cotter pin 51** or equivalent. Of course, the rotor is splined to the shaft in any conventional fashion.

The sheave 38 is connected to the shaft of an electric motor 12 which is mounted for horizontal pivotal movement on a plate assembly 16 by means of bolts 39 or other appropriate securing devices. The mounting plate's end **16*f* is hingedly connected to the pivot pin 16*g* and its other end 16*e* is fixed at the desired angle by nuts 41 fastened to the threaded members 16*a* and 16*b* on either side of the end portion 16*e* of the plate. The other ends of the threaded members 16*a*, 16*b* are respectively provided with transverse apertures through which pivot pins 16*c* pass, the apertures being aligned with corresponding apertures in two sets of parallel horizontal mounting structures 16*d* which are welded or otherwise attached to the outer side wall of the chute 14. Tension on the belts may be arranged by adjusting the angle of the pivot plate about the pivot pin 16*g***.

SWING-AWAY HOPPER ASSEMBLY

In prior machines of the type hereindescribed, the hopper was suspended at a number of points around its upper rim from the upper skirt 19 (or equivalent) by means of a plurality of bolts or other relatively fixed securing mechanisms which, when released, permitted the hopper to be let down or dropped. This allowed an operator access to its interior wall for cleaning, to the rotor 50 for cleaning or to the circular series of depending fixed impactors 40. However, these hoppers were quite heavy and they required two or more men sometimes working with lift trucks or the like to loosen the securing bolts and nuts (or equivalent) and, when all were removed, gradually lower the heavy hopper to the ground or other supporting surface, an operation requiring a considerable amount of time and presenting certain hazards to the bodies of the men.

In accordance with one feature of the present invention, the hopper 20 is suspended for easy pivotal damped downward movement by one person that enables him to gain easy access to its interior and to the rotor, etc. within a very short time and without appreciable risk to his person.

The hopper 20 is provided with a gas spring assembly 22 (FIGS. 1 and 4) having an arm **22*h* whose upper end is provided with a transverse aperture through which pivot pin 22*b* passes. The pin 22*b* also passes through aligned apertures formed in two substantially planar, parallel members 22*a* whose edges are attached as by welding to the inside surface of skirt member 19. The assembly 22 also includes a cylindrical portion 22*e* into which the arm 22*h* slides to produce the damping and biasing effects. The cylindrical member 22*e* has attached to its lower end a rod 22*j* which is provided with a transverse aperture 22*d* through which a pivot pin 22*f* is passed, the pin also passing through correspondingly aligned transverse apertures in two substantially planar members 22*g* which are attached, as by welding, to the exterior surface of the hopper 20**.

As stated above, the hopper is suspended at several, say 12, points around its peripheral edge portion **20*b* by a number of angled members 24 which are fixed in position by depending hexagonal nuts 23 that are screwed into threaded apertures in the top body skirt 19. To release the hopper, these hexagonal nuts are first all removed and then the operator presses down on the handles 20*a* at points opposite the pivot mechanism 22. Approximately 10 pounds pressure may be sufficient to start the pivoting action of the hopper with the gas spring assembly 22 acting as a snubber or damper to give a controlled descent. When the hopper is swung out of the way, the operator may then clean its inside, or change the rotor 50 by removing cotter pin 51, or repair or clean the circular set of depending impactors 40, or remove the rotor 50 entirely to permit the seal cartridge assembly 29** to be removed as explained below.

After cleaning or performing maintenance on the mechanism exposed after the hopper is swung down, the operator pulls upward on the handles **20*a*, again with approximately 10 pounds force abetted by the biasing action of the gas spring assembly 22. When the hopper is restored to its original position, the angled members 24 are again fixed in position supporting the peripheral edge portion 20*b* and the hexagonal nuts 23** are then screwed in.

Removable Seal Cartridge

In accordance with another feature of the present invention, the apparatus is provided with a removable seal cartridge indicated generally at the numeral 29 in FIG. 5. There is, of course, an upper bearing and seal assembly depicted generally at the numeral 27 with inlet and outlet plugs for lubricating the bearings under pressure or otherwise in conventional style. The lower removable seal cartridge 29 is of primary concern and comprises a generally cylindrical main body structure **29*a* formed of metal or other appropriate strong, hard substance. Within a generally annular shoulder region an upper seal member 29*q* is placed, the seal being made of Teflon or other smooth, highly heat resistant, low-friction yieldable material. As shown, the seal 29*q* has a generally inverted U-shaped cross-section and bears inwardly against the rotating surface of the shaft portion 25*c*. The seal is maintained in place by a compressible metal retaining ring 29*p* that fits in a circular groove provided for it. There is a corresponding lower seal member 29*s* similarly arranged and retained in position by a compressible ring 29*r*. Lubrication of the seals is provided through passageway 29*d* which communicates with the annular space 29*t* and is ordinarily stopped-up by plug 29*e*. The lubricating material may be withdrawn from this space via external channel 29*f* that may be plugged by plug 29*g***.

Toward the bottom of the seal there is a central generally annular hollowed-out portion **29*w* surrounding the upper part of the shaft portion 25*d*. This is provided with two or more transverse passageways 29*k* and 29*l*. These passageways are provided to enable an extraction tool to be inserted from below into the space 29*w* and then outwardly into the passages 29*k* and 29*l*. By pulling down with the extraction tools in the passageways, once the retaining plug 29*c* has been pulled out of its protrusion into the retaining hole 29*b*, the entire cartridge 29 may be easily removed from the shaft housing 33 for cleaning, replacement of the seals 29*q* and 29*s*, etc. This, of course, assumes that previously the rotor 50 has been removed by withdrawing the retaining cotter pin 51 after the hopper 20** has been released at its upper edge and pivoted downward out of the way.

Top Spindle Mount

Another feature of the present invention is shown in some detail in FIGS. 2 and 3. If it is desired to remove the spindle, it is a relatively simple matter. All that is necessary is to, first, remove the rotor by swinging down the hopper and removing the cotter pin 51. Then, the belts 13 are removed following which the top shaft retaining plate 30 is removed. This plate 30 is fixed to two horizontal bars 34, 35 which are welded or otherwise attached to the inner surfaces of the chutes 14, 15. Each of the plates 34, 35 is provided with two apertures which are aligned with corresponding apertures in the plate 30 through which bolts 32 are passed, being fastened at their lower ends on the lower side of the plates 34, 35, by nuts or other appropriate means. When these bolts have been removed, the entire shaft and shaft housing may be pulled upward out of the apparatus for service. The opposite procedure is followed when the shaft is replaced within the machine.

General Remarks

The apparatus described represents an important advance in the design of rotary processing machinery, especially of the centrifugal impacting type. Because of its design, it takes considerably less floor space than former designs such as those pictured in U.S. Pat. Nos. 3,102,781 and 3,171,604. The machine can be designed for belt drive as shown or for direct drive. Moreover, it is much easier to mount the motor than the previous "H" mount of the motor mounted on rails and is more economical to build. Its generally unitized construction also makes it stronger and makes it more free from vibration problems.

The double inlet can be supplemented by adding a generally V-shaped double chute inlet with a central top opening that divides the input unitary flow into two separate flows down through each of the chutes 14, 15.

We claim:

1. Rotary processing apparatus comprising, in combination:

a. a supporting frame assembly, b. a vertical rotary spindle mounted atop and through said frame, c. a processing rotor within said frame releasably attached to the lower end portion of said spindle, d. motor means for imparting rotary motion to said spindle and including means coupled to said spindle for driving the latter, e. at least two chute means for conducting material to be processed to said rotor for processing thereby, said chute means being mounted atop said frame assembly, f. mounting means supported by and connected to the sides of both of said chute means and providing the primary support for said motor means laterally of said chute means, g. a normally vertical hopper into which processed material falls which is pivotally mounted to said frame permitting it to be swung downward from a position primarily below and partially around said rotor and concentric therewith to a position enabling access to the interior of said hopper and to the environs of said rotor.

2. The apparatus according to claim 1 with the addition of a removable seal cartridge assembly adapted to make contact with said spindle, said cartridge seal assembly being removable by axial movement along said shaft without withdrawing said spindle from said frame assembly.

3. The apparatus according to claim 2 with the addition of a housing around at least part of said spindle and said seal cartridge assembly is retained in said housing by a releasable retaining mechanism which engages said housing and said cartridge.

4. The apparatus according to claim 3 wherein said retaining mechanism comprises a rigid member which passes through an aperture in said housing and engages a hole in said cartridge, said rigid member being accessible from outside said housing.

5. Apparatus according to claim 3 wherein said seal cartridge assembly is generally annular, includes at least one resilient seal member adapted to engage said shaft and is provided with means for introducing a lubricant into contact with said shaft, said last-mentioned means comprising passageways formed in said assembly substantially transverse to the axis of said spindle, said passageways being adapted to be placed in alignment with corresponding transverse apertures in said housing.

6. The apparatus according to claim 3 wherein said seal cartridge assembly is removable from below said portion of said frame assembly through which the rotary spindle passes in a downward direction substantially along the axis of said spindle.

7. The apparatus according to claim 1 wherein said mounting means is so disposed that said motor may be arranged to be at a desired angular position relative to said spindle.

8. The apparatus according to claim 1 wherein said hopper is mounted to said frame by gas spring means which damps downward movement of said hopper and abets upward movement thereof.

9. The apparatus according to claim 8 wherein there is an attachment of a rigid pivot arm fixed to an upper part of said hopper, the other end of said arm being connected to pivot about a pin fixed to said supporting frame, and further wherein said gas spring means is fixed to a lower part of said hopper and its other end is mounted for pivotal movement about a pin connected to said frame.

10. Rotary processing apparatus according to claim 1 wherein suspending means are attached toward the tops of both of said chute means and coupled to said spindle for suspending the upper portion of said spindle in a fixed orientation, said suspending means being easily removable thereby to permit withdrawal of said spindle upward after said processing rotor has been detached from the lower end of said spindle.

11. The processing apparatus according to claim 10 wherein said suspending means comprises a plate having an aperture therein through which said shaft is passed, and wherein said plate is removably attached to said chute means.

12. The apparatus according to claim 11 wherein both of said chute means have apertured horizontal members extending therefrom, said chute means being located on opposite sides of said spindle, and wherein said plate includes a plurality of additional apertures which are alignable with the apertures in said horizontal members, and further wherein means are provided for engaging said aligned apertures to fix said plate into position.

13. The processing apparatus according to claim 10 wherein said suspending means is directly connected to said chute means.

* * * * *